US010527253B2

(12) United States Patent
Lin et al.

(10) Patent No.: US 10,527,253 B2
(45) Date of Patent: Jan. 7, 2020

(54) VEHICLE LIGHT ASSEMBLY

(71) Applicant: T.Y.C. BROTHER INDUSTRIAL CO., LTD., Tainan (TW)

(72) Inventors: Min-Feng Lin, Tainan (TW); Yu-Bin Thao, Tainan (TW); Shih-Ting Tsai, Tainan (TW)

(73) Assignee: T.Y.C. BROTHER INDUSTRIAL CO., LTD., Tainan (TW)

( * ) Notice: Subject to any disclaimer, the term of this patent is extended or adjusted under 35 U.S.C. 154(b) by 380 days.

(21) Appl. No.: 15/486,084

(22) Filed: Apr. 12, 2017

(65) Prior Publication Data

US 2018/0299094 A1 Oct. 18, 2018

(51) Int. Cl.
*F21V 1/00* (2006.01)
*F21S 45/49* (2018.01)

(52) U.S. Cl.
CPC ..... *F21S 45/49* (2018.01)

(58) Field of Classification Search
CPC .. F21S 45/49; F21S 45/47; F21S 43/40; F21S 43/315; F21S 43/27; F21S 43/14; F21S 43/26
See application file for complete search history.

(56) References Cited

U.S. PATENT DOCUMENTS 6,280,071 B1 * 8/2001 Yamamoto ..... B60Q 1/06 362/539
2015/0062919 A1 * 3/2015 Teodecki ..... F21S 41/29 362/311.02
2015/0062952 A1 * 3/2015 Lessard ..... F21V 5/04 362/549

* cited by examiner

*Primary Examiner* — William J Carter
*Assistant Examiner* — Omar Rojas Cadima
(74) *Attorney, Agent, or Firm* — Hamre, Schumann, Mueller & Larson, P.C.

(57) ABSTRACT

A vehicle light assembly includes a lens unit, a lens cover, a heat dissipation seat, a clamp and a plurality of fasteners. The lens cover is connected to the lens unit. The heat dissipation seat is disposed rearward of the lens unit and the lens cover. The clamp is connected to a front side of the heat dissipation seat and defines a clamping space receiving the lens unit and the lens cover. The clamp clamps tightly the lens cover against the lens unit. The fasteners are threaded forwardly into the lens cover from a rear side of the dissipation seat.

10 Claims, 7 Drawing Sheets

VEHICLE LIGHT ASSEMBLY

FIELD

The disclosure relates to a lens assembly, and more particularly to a vehicle light assembly.

BACKGROUND

Referring to FIGS. 1 and 2, an existing vehicle light assembly includes a plurality light emitters 90, a lens unit 91 for transmitting lights from the light emitters 90, two cover halves 90 connected to top and bottom sides of the lens unit 91, a mounting seat 93 for mounting the lens unit 91 and the cover halves 92, and a heat dissipation seat 94 for assembly with the mounting seat 93 and the light emitters 90. The mounting seat 93 includes a base wall 931 and a plurality of spaced-apart connection walls 932 projecting forwardly from the base wall 931.

During assembly of the vehicle light assembly, the cover halves 92 are respectively mounted on the top and bottom sides of the lens unit 91 through a plurality of fasteners 95 fastening together the cover halves 92. The mounting seat 93 is secured to a front side of the heat dissipation seat 94 by a plurality of fasteners 96 threaded from front to rear into the mounting seat 93 and the heat dissipation seat 94. Thereafter, the cover halves 92 and the lens unit 91 are disposed into the mounting seat 93, and the connection walls 932 of the mounting seat 93 are welded to the cover halves 92 by laser spot welding. The assembly of the cover halves 92 and the lens unit 91 are therefore firmly mounted on the mounting seat 93.

However, the particular design of the mounting seat 93 leads to a limitation, which requires an extra processing step to couple the mounting seat 93 to the cover halves 92. That is to say, the mounting seat 93 has to be welded to the covers 92 by laser spot welding. The cost of the laser spot welding equipment is high, and the extra processing step is cumbersome and time consuming. In addition, the assembling process requires several screwing steps, which are troublesome and time consuming, because the fasteners 95 are needed to fasten together the cover halves 92 and the fasteners 96 are needed to fasten the mounting seat 93 to the heat dissipation seat 94.

SUMMARY

Therefore, an object of the disclosure is to provide a vehicle light assembly that can alleviate at least one drawback of the prior art.

According to the disclosure, a vehicle light assembly includes a lens unit, a lens cover, a heat dissipation seat, a clamp and a plurality of fasteners.

The lens unit includes a front light exit face, a rear light entrance face opposite to the light exit face, and a light reflection face extending from the light entrance face to the light exit face.

The lens cover is connected to the lens unit and extends forward from the light entrance face and around the light reflection face.

The heat dissipation seat is disposed rearward of the lens unit and the lens cover.

The clamp is connected to a front side of the heat dissipation seat and defines a clamping space receiving the lens unit and the lens cover and having an opening that faces forwardly. The clamp clamps tightly the lens cover against the lens unit.

The fasteners are threaded forwardly into the clamp and the lens cover from a rear side of the dissipation seat.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
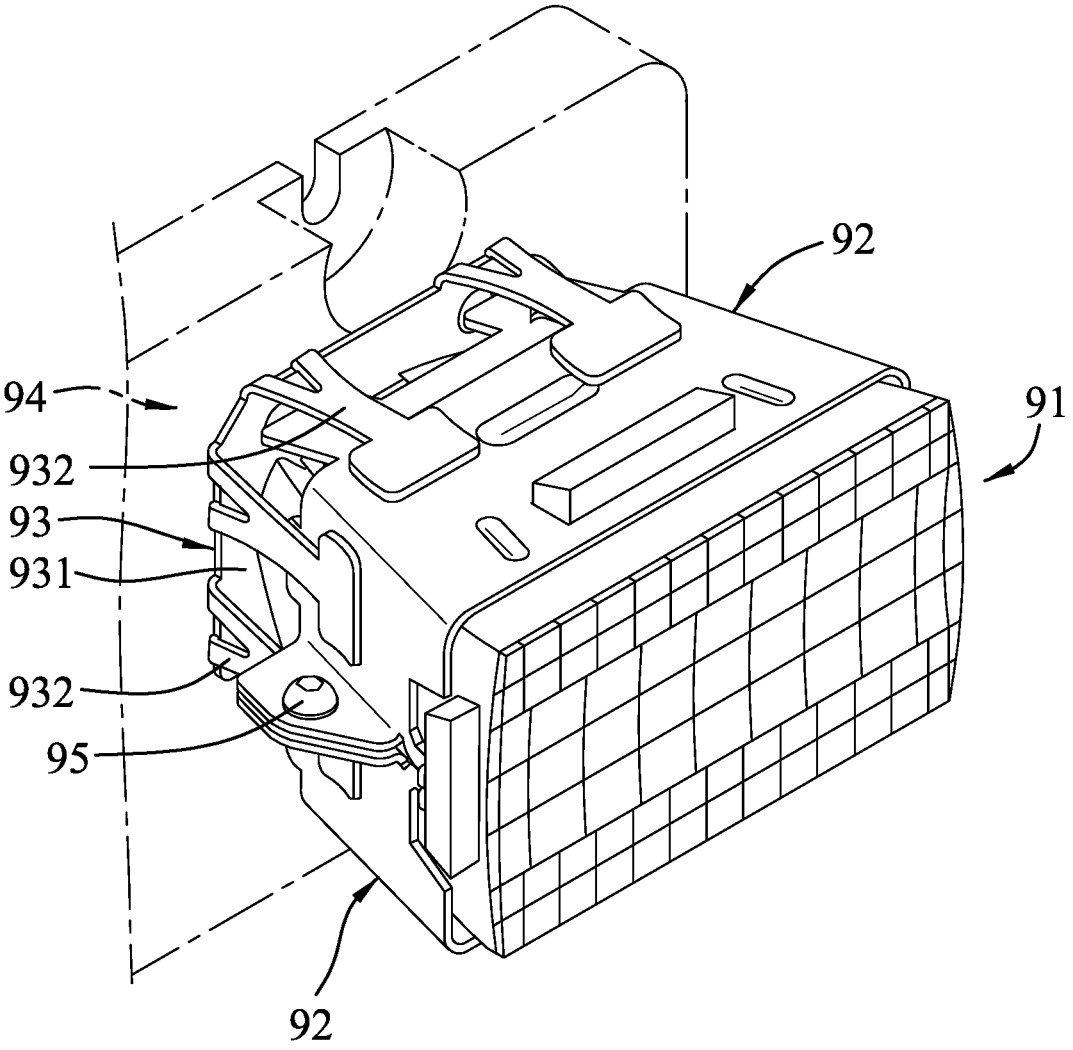
FIG.1 PRIOR ART
FIG. 1 is a perspective view of an existing vehicle light assembly.
Figure 2:
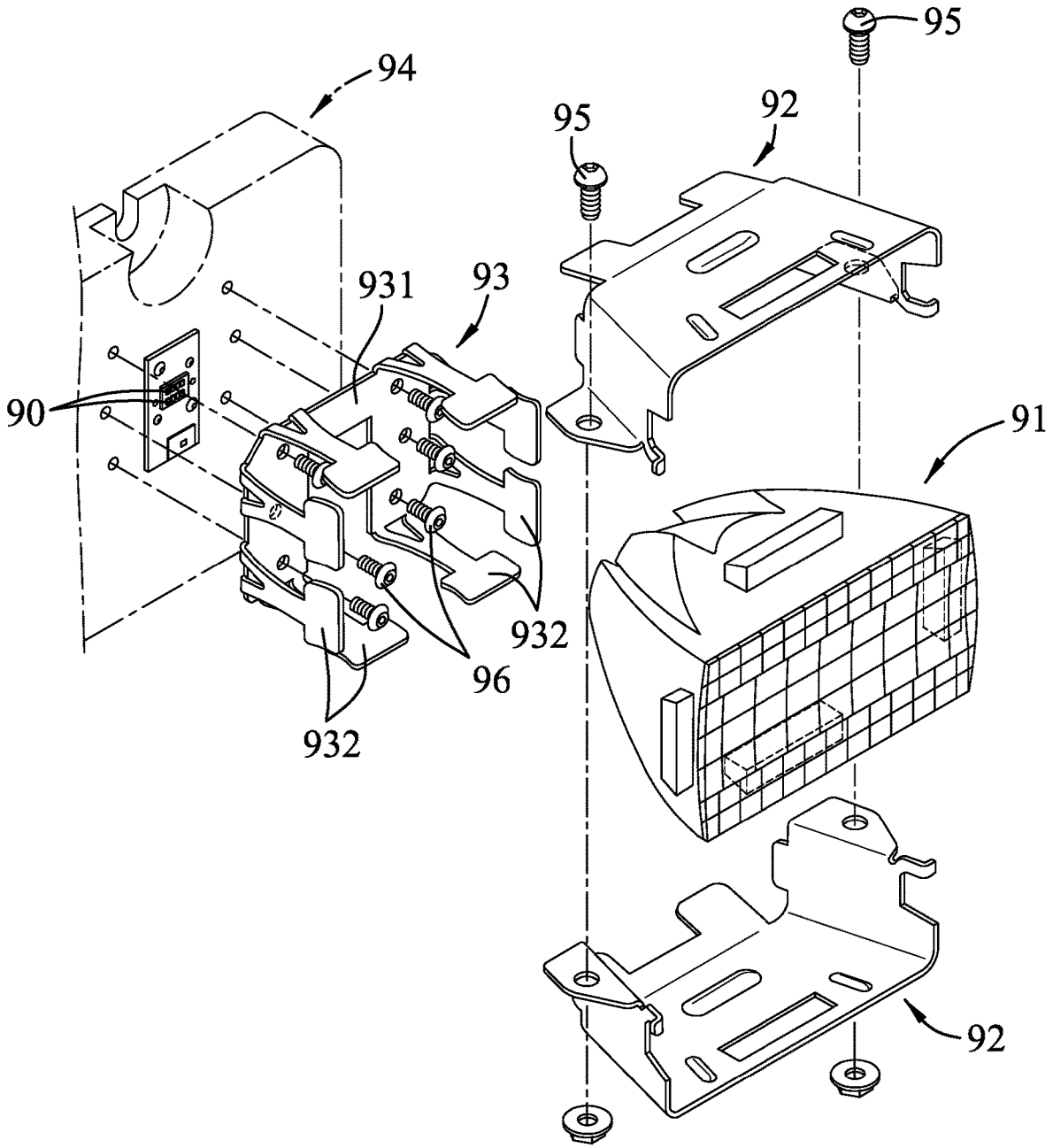
FIG.2 PRIOR ART
FIG. 2 is an exploded perspective view of the existing vehicle light assembly.
Figure 3:
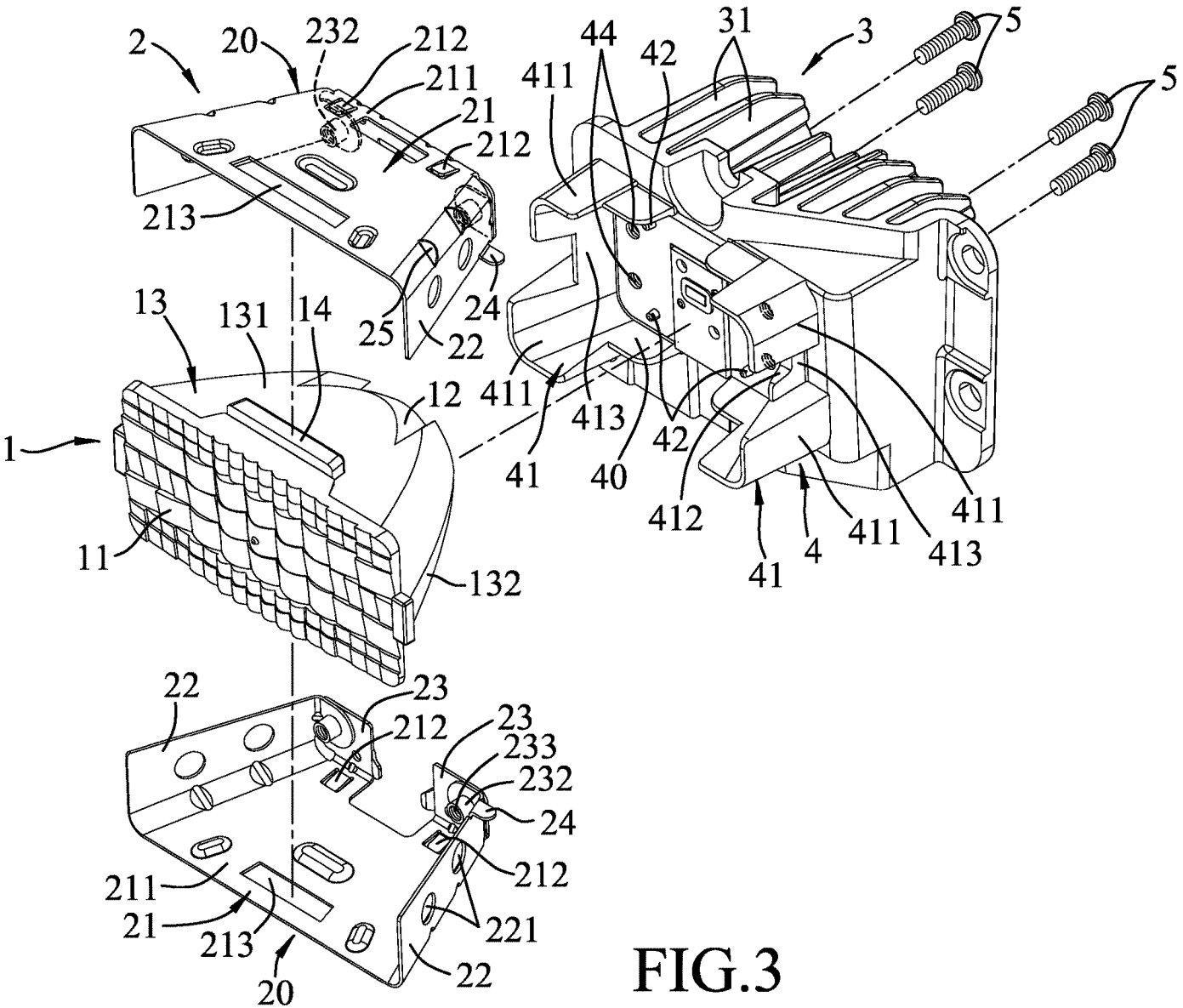
FIG. 3 is an exploded front perspective view, illustrating a vehicle light assembly according to an embodiment of the present disclosure.
Figure 4:
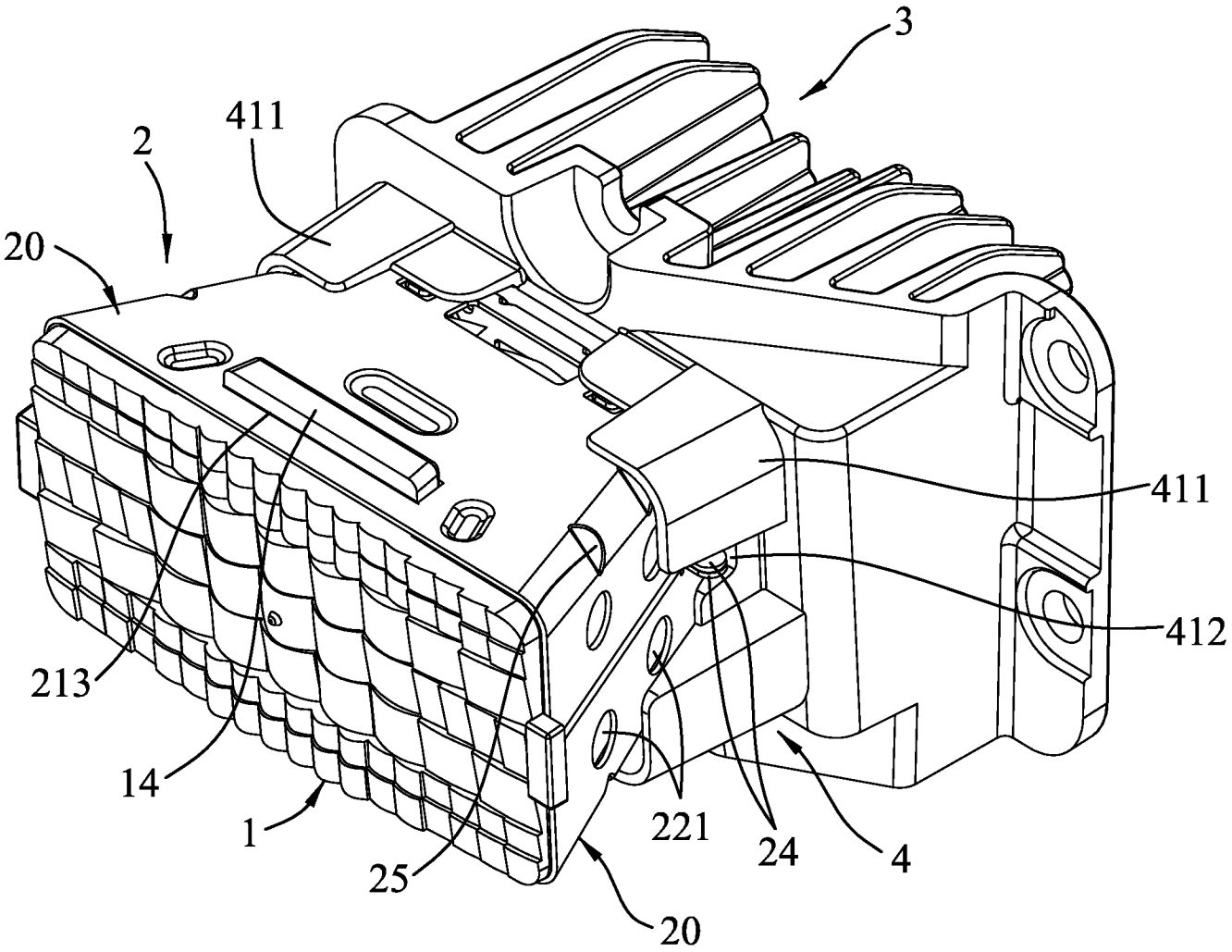
FIG. 4 is a perspective view of the embodiment.
Figure 6:
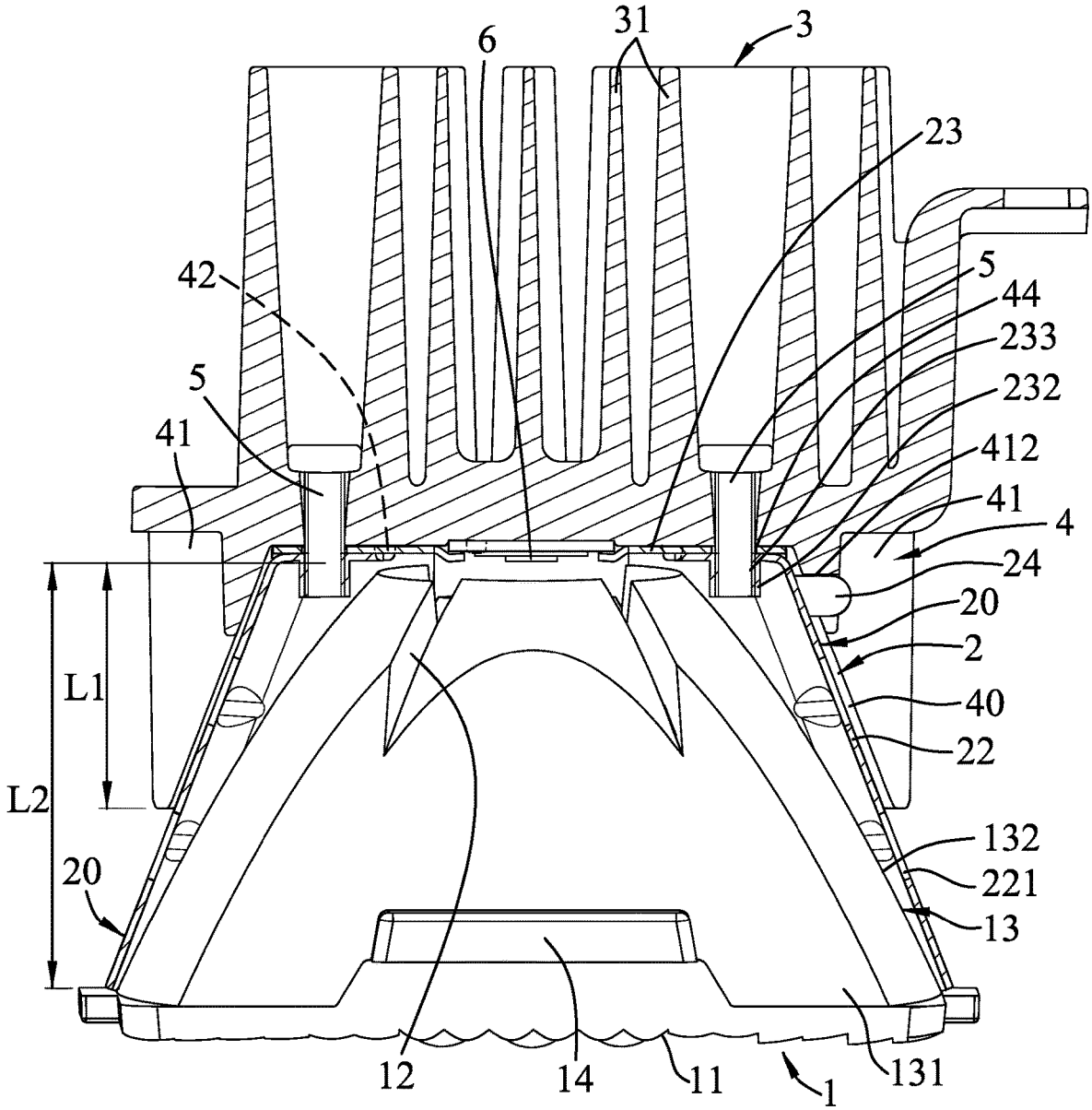
FIG. 6 is a top sectional view of the embodiment.

Referring to FIGS. 3 and 4, a vehicle light assembly according to an embodiment of the present disclosure is suitable for transmitting lights from a light emitter 6 (see FIG. 6). The vehicle light assembly includes a lens unit 1, a lens cover 2, a heat dissipation seat 3, a clamp 4 and a plurality of fasteners 5.

Figure 5:
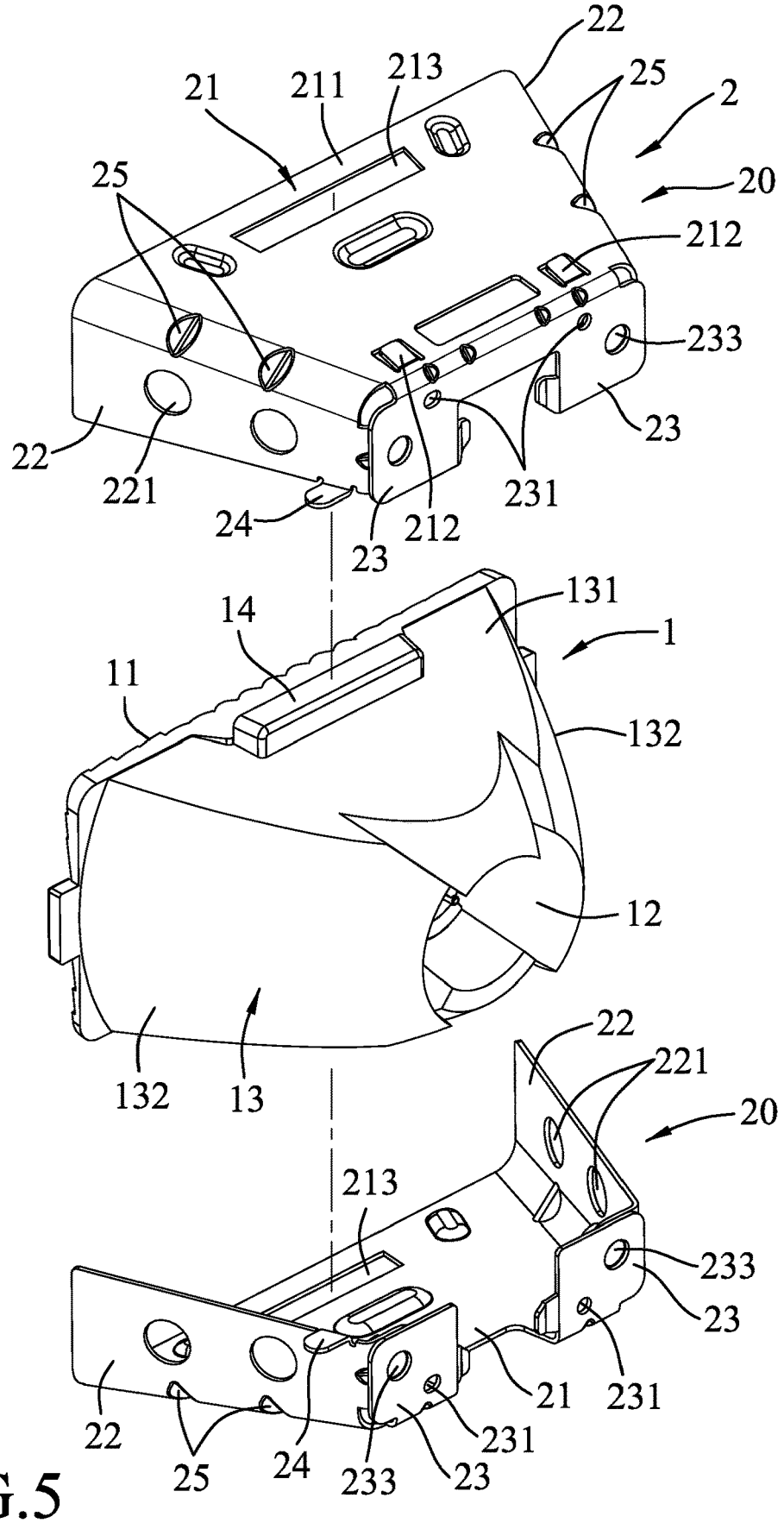
FIG. 5 is an exploded rear perspective view of the embodiment.

Referring to FIGS. 5 and 6, in combination with FIG. 3, the lens unit 1 includes a front light exit face 11, a rear light entrance face 12 opposite to the light exit face 11, and a light reflection face 13 extending from the light entrance face 12 to the light exit face 11. The light reflection face 13 has two first reflection face sections 131 spaced apart from each other in a top-bottom direction, and two second reflection face sections 132 spaced apart from each other in a left-right direction and connected to the first reflection face sections 131. The light entrance face 12 allows the lights of the light emitter 6 to enter the lens unit 1. The light reflection face 13 reflects the lights of the light emitter 6 to exit the light exit face 11. In addition, the lens unit 1 further includes two projections 14 that are different in size and that project respectively from the first reflection face sections 131 in upward and downward directions.

Referring back to FIGS. 3 to 5, the lens cover 2 is connected to the lens unit 1 and extends forward from the light entrance face 12 and around the light reflection face 13. The lens cover 2 includes two cover halves 20 detachably connected to two opposite sides of the lens unit 1. Each of the cover halves 20 has a first wall 21, two second walls 22, two third walls 23, a positioning tab 24 and a plurality of reinforcement dents 25. The first wall 21 covers one of the first reflection face sections 131. The second walls 22 respectively extend from two opposite ends of the first wall 21 to lie over the second reflection face sections 132. The third walls 23 bend respectively from the second walls 22 toward each other and extend over a rear side of the light entrance face 12. The positioning tab 24 projects outwardly from one of the second walls 22 in the left-right direction. Each of the reinforcement dents 25 is formed in a corner where the first wall 21 meets one of the second walls 22.

In this embodiment, the first wall 21 has a wall panel 211, two resilient tabs 212 spaced apart from each other and projecting outwardly from the wall panel 211, and a through hole 213 formed in the wall panel 211 for insertion of one of the projections 14. The resilient tabs 212 of one of the cover halves 20 disposed above the lens unit 1 project upwardly from the wall panel 211. The resilient tabs 212 of the other one of the cover halves 20 disposed beneath the lens unit 1 project downwardly from the wall panel 211. In addition, the through holes 213 of the cover halves 20 are different in size and are respectively and dimensionally matchable with the projections 14.

Each of the second walls 22 has a plurality of spaced-apart ventilating holes 221 that increase ventilation and improve heat convection to help dissipate heat. In addition, the ventilating holes 221 may change vibration frequency of the cover halves 20 to prevent damage caused by resonances of vibrations during use. Further, because of the formation of the ventilating holes 221, weights of the cover halves 20 may be reduced to thereby reduce the total weight of the vehicle light assembly of the present disclosure. The second walls 22 are inclined toward each other from front to rear, so that the lens cover 2 is tapered rearward.

Each of the third walls 23 has a protrusion-receiving hole 231 extending therethrough, and a forwardly protruding hollow post 232 spaced apart from the protrusion-receiving hole 231. The forwardly protruding hollow post 232 defines a threaded hole 233.

The heat dissipation seat 3 is disposed rearward of the lens unit 1 and the lens cover 2. For the sake of brevity, the details of the heat dissipation seat 3 are omitted hereinafter.

Referring back to FIGS. 3, 5 and 6, the clamp 4 is connected to a front side of the heat dissipation seat 3, and clamps tightly the lens cover 2 against the lens unit 1. In this embodiment, the clamp 4 and the heat dissipation seat 3 are formed integrally as one piece. The clamp 4 includes two clamping walls 41 spaced apart in a left-right direction, and four protrusions 42 respectively inserted into the protrusion-receiving holes 231 of the third walls 23.

The clamping walls 41 cooperatively define a clamping space 40 receiving the lens unit 1 and the lens cover 2 and having an opening that faces forwardly. The clamping space 40 is tapered from a front end of the clamp 4 to a rear end of the clamp 4. The lens cover 2 has a tapered configuration, which conforms to that of the clamping space 40 such that the lens cover 2 can be clamped tightly in the clamping space 40.

The clamping walls 41 clamp around the lens cover 2. Each of the clamping walls 41 has two corner sections 411 spaced apart in a top-bottom direction and a middle section 413 connected between and indented from the corner sections 411. One of the clamping walls 41 further has a positioning groove 412 indented into the middle section 413. The positioning tabs 24 of the cover halves 20 are inserted into the positioning groove 412.

One of the clamping walls 41 clamps together the two cover halves 20 at a left side of the lens cover 2. Each corner section 411 of the clamping wall 41 at the left side abuts against one corner of one of the cover halves 20 at the left side. The other one of the clamping walls 41 clamps together the two cover halves 20 at a right side of the lens cover 2. Each corner section 411 of the other clamping wall 41 at the right side abuts against one corner of one of the cover halves 20 at the right side.

The fasteners 5 are threaded forwardly into the lens cover 2 and the clamp 4 from a rear side of the dissipation seat 3 through the threaded holes 233 of the forwardly protruding hollow posts 232.

During manufacturing process, each of the cover halves 20 is punched from a metal plate, such as a stainless steel plate, to shape and bend the first, second and third walls 21, 22, 23. The two resilient tabs 212, the positioning tab 24, the forwardly protruding hollow posts 232 and the reinforcement dents 25 are formed by a punching process. In this embodiment, after the forwardly protruding hollow post 232 is formed integrally as one-piece with the third wall 23 by the punching process, an inner surface of the forwardly protruding hollow post 232 is machined to form the threaded hole 233 for threaded insertion of one of the fasteners 5. Because the forwardly protruding hollow post 232 may function as a nut, assembly may be conducted without using a nut and be convenient. Generally, the stainless steel plate has a high elasticity coefficient, a certain amount of rebound may occur after a bending process. Therefore, the shapes of the cover halves 20 as produced may be different from the predetermined forms thereof. The reinforcement dents 25, which are punched and formed in the corners where the first wall 21 meet the second walls 22 in each cover half 20, are used to provide the cover half 20 with an increased strength for absorbing or resisting elastic deformation so that the deformation problem of the cover halves may be avoided.

During assembly, the cover halves 20 are first connected respectively to top and bottom sides of the lens unit 1 to sandwich the lens unit 1. Because the through holes 213 of the cover halves 20 are different in size to match with the differently sized projections 14, it is easy to ensure that the cover halves 20 are at their correct positions after assembly with the lens unit 1.

Subsequently, the cover halves 20 and the lens unit 1 are inserted into the clamp 4. Because the clamping walls 41 have different configurations, the orientation of the cover halves 20 is needed to match with that of the clamping walls 41. When the positioning tabs 24 of the cover halves 20 are inserted into the positioning groove 412 of one of the clamping walls 41, it can be ensured that the cover halves 20 are at their correct positions with respect to the clamping walls 41. During insertion of the cover halves 20 and the lens unit 1 into the clamp 4, the cover halves 20 are deformed and press-fitted into the clamping space 40 and clamped by the clamping walls 41, and the protrusions 42 are respectively inserted into the protrusion-receiving holes 231 of the third walls 23 to adjust and correct the positions of the cover halves 20 with respect to the clamp 4, such that the protruding hollow posts 232 of the third walls 23 are aligned with fastening holes 44 formed in the clamp 4. After the fasteners 5 are screwed into the protruding hollow posts 232 of the third walls 23, the lens cover 2 is fixed to the clamp 4.

Figure 7:
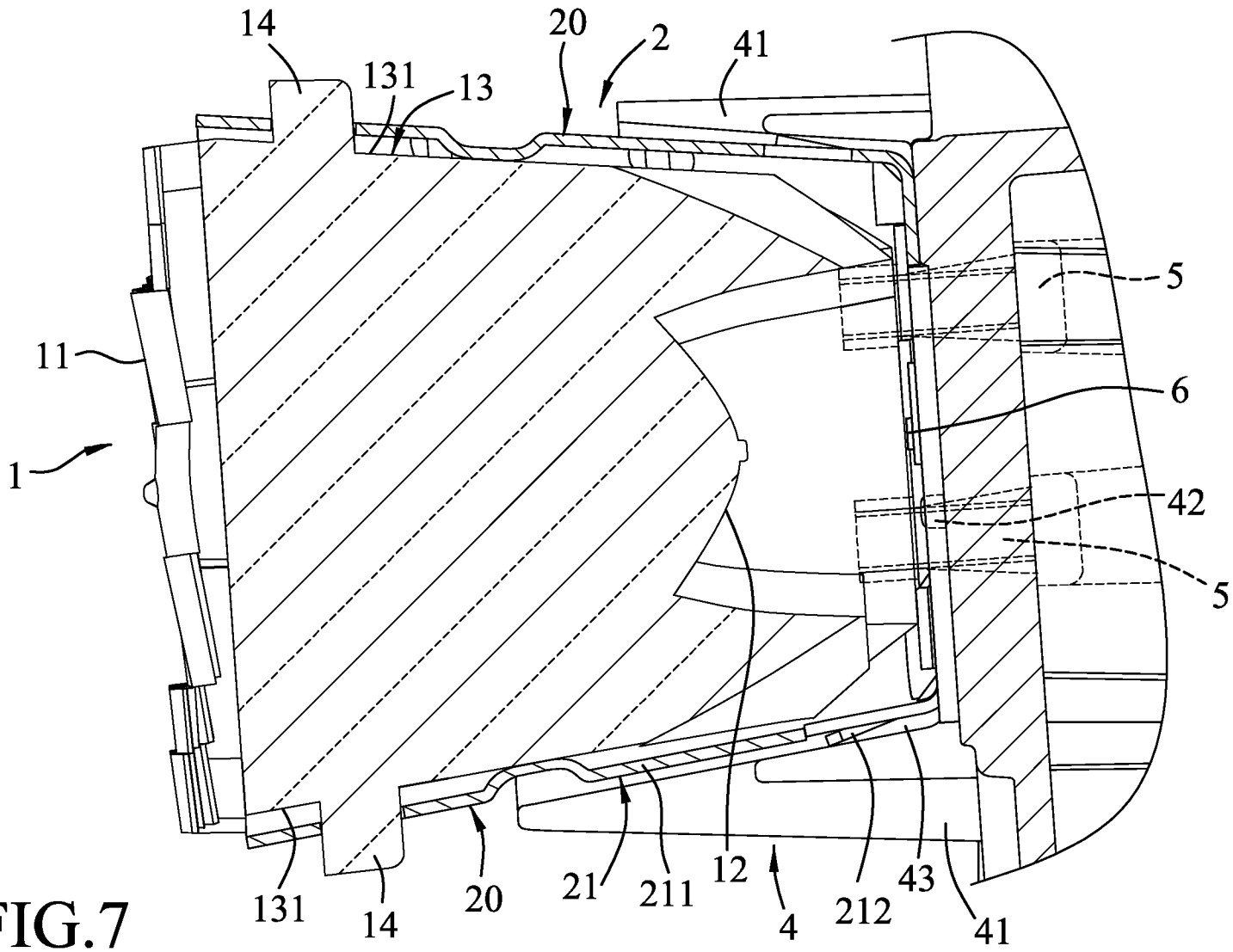
FIG. 7 is a side sectional view of the embodiment.

Referring to FIG. 7, in combination with FIGS. 4 and 6, after assembling the lens unit 1, the lens cover 2 and the clamp 4, the clamp 4 clamps tightly the lens cover 2 against the lens unit 1. In this embodiment, the first and second walls 21, 22 of the cover halves 20 abut against inner surfaces of the clamping walls 41 of the clamp 4. In addition, each clamping wall 41 and each cover half 20 have tapered configurations that conform to each other, so that the lens cover 2 can be inserted easily into and clamped tightly by the clamp 4. Further, the resilient tabs 212 of the first walls 21 of the cover halves 20 abut against the inner surfaces of the clamping walls 41 of the clamp 4. Due to the manufacture tolerance occurring during mass production of the cover halves 20 by punching, there may be a clearance 43 (see FIG. 7) between the inner surface of the clamp 4 and the lens cover 2. The clearance 43 caused by the manufacture tolerance may vary and may be about ±1 mm. The resilient tabs 212 are used to abut against the clamping walls 41 for absorbing dimensional variation of the clearance 43 and for preventing vibration noises.

As shown in FIG. 6, the lens cover 2 has an insertion portion that extends into the clamping space 40 and that has a length (L1) along a front-rear direction. The length (L1) is larger than half of a total length (L2) of the lens cover 2 along the front-rear direction. Therefore, the clamp 4 provides a sufficient clamping area that is able to efficiently embrace the lens cover 2.

In sum, by virtue of the structural arrangement of the clamp 4, the lens unit 1 and the lens cover 2 can be easily and firmly clamped by the clamp 4, thereby facilitating the assembling process and saving the assembling time. In addition, stability of the assembly may be further enhanced by the fasteners 5 screwed into the clamp 4 and the lens cover 2. Because the clamp 4 and the heat dissipation seat 3 are formed integrally as one piece, and because no laser spot welding operation is required for completing the vehicle light assembly of the present disclosure, equipment costs and time for the assembling processes may be reduced.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A vehicle light assembly, comprising:

a lens unit including a front light exit face, a rear light entrance face opposite to said light exit face, and a light reflection face extending from said light entrance face to said light exit face;

a lens cover connected to said lens unit and extending forward from said light entrance face and around said light reflection face;

a heat dissipation seat disposed rearward of said lens unit and said lens cover;

a clamp connected to a front side of said heat dissipation seat and defining a clamping space receiving said lens unit and said lens cover and having an opening that faces forwardly, said clamp clamping tightly said lens cover against said lens unit; and a plurality of fasteners that are threaded forwardly into said clamp and said lens cover from a rear side of said heat dissipation seat, wherein said clamp includes two clamping walls spaced apart in a left-right direction and cooperatively defining said clamping space, each of said clamping walls having two corner sections spaced apart in a top-bottom direction, and a middle section connected between and indented from said corner sections, one of said clamping walls clamping together two cover halves at a left side of said lens cover, each of said corner sections of said one of said clamping walls abutting against one corner of one of said cover halves at the left side of said lens cover, an other one of said clamping walls clamping together two cover halves at a right side of said lens cover, each of said corner sections of said other one of said clamping walls abutting against one corner of one of said cover halves at the right side of said lens cover, wherein one of said clamping walls further has a positioning groove indented into said middle section, said lens cover having a positioning tab inserted into said positioning groove, and wherein each of said cover halves further has first, second and third walls, two of said two walls bend respectively from said second walls toward each other and extend over a rear side of said light entrance face, each of said third walls having a protrusion-receiving hole, said clamp including four protrusions respectively inserted into said protrusion-receiving holes of said third walls.

2. The vehicle light assembly as claimed in claim 1, wherein said lens cover has an insertion portion that extends into said clamping space and that has a length along a front-rear direction, the length being larger than half of a total length of said lens cover along the front-rear direction.

3. The vehicle light assembly as claimed in claim 1, wherein said clamping space is tapered from a front end of said clamp to a rear end of said clamp, said lens cover has a tapered configuration which conforms to that of said clamping space such that said lens cover is clamped tightly in said clamping space.

4. The vehicle light assembly as claimed in claim 1, wherein said clamp and said heat dissipation seat are formed integrally as one piece.

5. The vehicle light assembly as claimed in claim 1, said clamping walls clamping around said lens cover, said positioning groove formed between said corner sections.

6. The vehicle light assembly as claimed in claim 1, wherein:

said light reflection face has two first reflection face sections spaced apart from each other in a top-bottom direction, and two second reflection face sections spaced apart from each other in a left-right direction; and said lens cover includes said two cover halves detachably connected to two opposite sides of said lens unit, each of said cover halves having said first wall covering one of said first reflection face sections, and said two second walls respectively extending from two opposite ends of said first wall to lie over said second reflection face sections.

7. The vehicle light assembly as claimed in claim 1, wherein said lens unit further includes two projections that are different in size and that project respectively and outwardly from said first reflection face sections, each of said cover halves having a through hole for insertion of one of said projections, said through holes of said cover halves being different in size and being respectively and dimensionally matchable with said projections.

8. The vehicle light assembly as claimed in claim 1, wherein each of said cover halves further has two reinforcement dents each of which is formed in a corner where said first wall meets one of said second walls.

9. The vehicle light assembly as claimed in claim 1, wherein said first wall has a wall panel and at least one resilient tab projecting outwardly from said wall panel.

10. A vehicle light assembly, comprising:

a lens unit including a front light exit face, a rear light entrance face opposite to said light exit face, and a light reflection face extending from said light entrance face to said light exit face;

a lens cover connected to said lens unit and extending forward from said light entrance face and around said light reflection face;

a heat dissipation seat disposed rearward of said lens unit and said lens cover;

a clamp connected to a front side of said heat dissipation seat and defining a clamping space receiving said lens unit and said lens cover and having an opening that faces forwardly, said clamp clamping tightly said lens cover against said lens unit; and a plurality of fasteners that are threaded forwardly into said clamp and said lens cover from a rear side of said heat dissipation seat, wherein said clamp includes two clamping walls spaced apart in a left-right direction and cooperatively defining said clamping space, each of said clamping walls having two corner sections spaced apart in a top-bottom direction, and a middle section connected between and indented from said corner sections, one of said clamping walls clamping together two cover halves at a left side of said lens cover, each of said corner sections of said one of said clamping walls abutting against one corner of one of said cover halves at the left side of said lens cover, an other one of said clamping walls clamping together two cover halves at a right side of said lens cover, each of said corner sections of said other one of said clamping walls abutting against one corner of one of said cover halves at the right side of said lens cover, wherein one of said clamping walls further has a positioning groove indented into said middle section, said lens cover having a positioning tab inserted into said positioning groove, and wherein each of said cover halves further has first, second and third walls, two of said two walls bend respectively from said second walls toward each other and extend over a rear side of said light entrance face, each of said third walls having a forwardly protruding hollow post defining a threaded hole threadedly receiving one of said fasteners.

* * * * *